US012655580B1

(12) United States Patent
Dunkle et al.

(10) Patent No.: US 12,655,580 B1
(45) Date of Patent: Jun. 16, 2026

(54) POLYESTER FIBER DYEING PROCESSES AND COMPOSITIONS THEREOF

(71) Applicant: Shaw Industries Inc., Dalton, GA (US)

(72) Inventors: Steven R Dunkle, Dalton, GA (US); Richard Rapp, Dalton, GA (US); Christopher Eric Bradley, Dalton, GA (US); Tansley Cornwell, Dalton, GA (US)

(73) Assignee: Shaw Industries, Inc., Dalton, GA (US)

( * ) Notice: Subject to any disclaimer, the term of this patent is extended or adjusted under 35 U.S.C. 154(b) by 503 days.

(21) Appl. No.: 18/364,920

(22) Filed: Aug. 3, 2023

Related U.S. Application Data

(60) Provisional application No. 63/394,690, filed on Aug. 3, 2022.

(51) Int. Cl.

| | |
|---|---|
| ***D06P 3/54*** | (2006.01) |
| ***D06P 1/651*** | (2006.01) |
| ***D06P 7/00*** | (2006.01) |

(52) U.S. Cl.
CPC ..... *D06P 3/54* (2013.01); *D06P 1/651* (2013.01); *D06P 7/00* (2013.01)

(58) Field of Classification Search
None
See application file for complete search history.

(56) References Cited

PUBLICATIONS https://patents.google.com/patent/CN102464899A/en?oq=CN102464899 (Year: 2010).*

* cited by examiner

*Primary Examiner* — Arti Singh-Pandey
(74) *Attorney, Agent, or Firm* — Smith Gambrell & Russell LLP

(57) ABSTRACT

Polyester fiber dyeing processes containing superior deep dye (SDD) additive are provided. Compositions for dyeing polyester fibers and composition for fiber manufacturing containing SDD are also provided.

20 Claims, 3 Drawing Sheets

POLYESTER FIBER DYEING PROCESSES AND COMPOSITIONS THEREOF

CROSS REFERENCE TO RELATED APPLICATIONS

This application claims priority to and benefit of U.S. Provisional Patent Application No. 63/394,690 filed on Aug. 3, 2022, and which is incorporated by reference in its entirety.

FIELD OF THE INVENTION

Embodiments described herein generally relate to textile dyeing methods and compositions. More particularly, such embodiments relate to polyester fiber dyeing processes and compositions thereof.

BACKGROUND OF THE INVENTION

Dyestuffs are commonly utilized in a combination of three primary colorants e.g., red yellow and blue, to provide the majority of the shades most often utilized to dye textile, specifically polyester fibers. Such a three dye combination is known as a "trichromy" and the related dyeing processes are known as "trichromatic dyeing." In formulating trichromatic dyeing formulations, the dye selection may focus on the specific dyes which will provide the most uniform dyeing rates. That is, it is usually desirable for the exhaustion rates for the red, yellow and blue dyes to be comparable so that the dye take up will be fairly uniform for each of the colors.

Manufacturers of dyestuffs often supply dyes to textile manufacturers in pure product form. Pure forms of dyestuffs are classified for identification by Color Index (CI) number. This system was developed by the American Association of Textile Chemists and Colorists (AATCC) to allow more uniform identification of dyestuff identity to the end user. Such dyes are sometimes called "standards." While pure dyes have some application for the dyeing of polyamide fibers, it is not uncommon for such pure dyestuffs to provide inferior dyeing performance in dyeing processes.

Manufacturers also supply dyes in mixtures of pure forms. Mixtures may be preferable to the pure form of the dyestuffs for reasons related to the shade desired and/or performance properties. In selecting dyes for use in dyeing, it is important that the color components be sufficiently compatible from a performance standpoint to allow them to effectively dye polyester fibers in a system. Such compatibility preferably relates to those dyes that provide uniform strike, build and exhaustion during the dyeing operation and to be able to reproduce the coloration in a consistent manner from batch to batch. Moreover, it can be exceedingly difficult to predict the particular performance of a dye, especially when the dye is combined with other dyes in a trichromatic process. Additionally, even though the performance of the dyed fiber may be initially acceptable, application of a stain resistant chemical may reduce the lightfastness of the dyed fiber.

Carpets, rugs, mats, and like floor coverings used in home and industrial applications are typically made from natural fibers (such as cotton and wool) or synthetic fibers (such as nylon, polyester, polyolefins, acrylics, rayon, and cellulose acetate). Synthetic fibers tend to be more favored in carpet manufacture, as they are generally more commercially acceptable and can be used for a wider variety of applications.

Polyester fibers are used in various fields mainly for apparel because of their mechanical properties, coloring properties, and handling properties. However, in general, polyester fibers are inferior in dyeability due to their dense fiber structure.

Polyethylene terephthalate (PET), a thermoplastic fiber polymer resin in the polyester family, is a commonly used synthetic fiber for carpet applications. One of the drawbacks of PET carpets is that they have lower dyeability (i.e. are less easily dyed) than other types of carpets, such as nylon.

Polytrimethylene terephthalate (PTT) is another polyester which may be used in carpeting. One way of improving the dyeability of PET is by blending it with PTT. However, adding PTT to PET in amounts high enough to create deep dyeing PET, reduces the strength of the fiber, meaning that the PET/PTT blend fiber will not be suitable for further processing.

Accordingly, a need exists for a polyester dyed carpet with improved strength qualities, and deep dyeability.

In light of the above, it would be desirable to develop an efficient dyeing process for polyester fibers that provides increased dye pick up on the polyester fibers. Furthermore, it would be desirable to develop an efficient dyeing process which provides improvements in lightfastness, sublimation fastness and cost.

Therefore, it is an object of the invention is to provide an efficient and repeatable textile dyeing process and a composition for dyeing fibers.

It is another object of the invention is to provide improved polyester fiber dyeing processes.

It is still another object of the invention is to provide increased dye pick up during polyester fiber dyeing processes.

It is also an object of the invention to provide improved light fastness and sublimation fastness of the dyed polyester fibers.

It is a further object of the invention to provide a cost-efficient polyester fiber dyeing process.

These needs and other needs are met by the various aspects of the present disclosure.

SUMMARY OF THE INVENTION

Polyester fiber dyeing processes and compositions are provided.

In some embodiments, a process of dyeing a polyester fiber, can include feeding a plurality of dried polyester pellets and superior deep dye (SDD) additive into a twin-screw extruder; mixing polyester pellets and SDD via screw configuration of the twin-screw extruder; removing the volatiles via connected vacuum pump to the twin-screw extruder; passing molten polyester pellets and SDD through a die to produce strands; pelletizing, crystallizing, drying the pellets to produce a concentrate; spinning blends of the concentrate and virgin polyester resin into a fiber; selectively applying one or more colors of dye at about 100° F.; adjusting the pH of the dye bath between 4-7; applying the stream for about 10 minutes at about 210° F.; rinsing the polyester fiber; applying after treatment; applying the stream for about 3 minutes at about 210° F.; and rinsing and drying the dyed polyester fiber.

In another embodiment, a process of dyeing a polyester fiber, can include feeding a plurality of dried polyester pellets and superior deep dye (SDD) additive into a single-screw extruder; mixing polyester pellets and SDD via screw configuration of the single-screw extruder; removing the volatiles via connected vacuum pump to the single-screw extruder; passing molten polyester pellets and SDD through a die to produce strands; pelletizing, crystallizing, drying the pellets to produce a concentrate; spinning blends of the concentrate and virgin polyester resin into a fiber; selectively applying one or more colors of dye at about 100° F.; adjusting the pH of the dye bath between 4-7; applying the stream for about 10 minutes at about 210° F.; rinsing the polyester fiber; applying after treatment; applying the stream for about 3 minutes at about 210° F.; and rinsing and drying the dyed polyester fiber.

In other embodiments, a composition for dyeing polyester fibers, can include a superior deep dye (SDD) additive; and a dye component, wherein the dye component is a disperse dye.

In further embodiments, a composition for fiber manufacturing can include a plurality of polyester fibers and a superior deep dye (SDD) additive.

DETAILED DESCRIPTION OF THE INVENTION

I. Definitions

Figure 1:
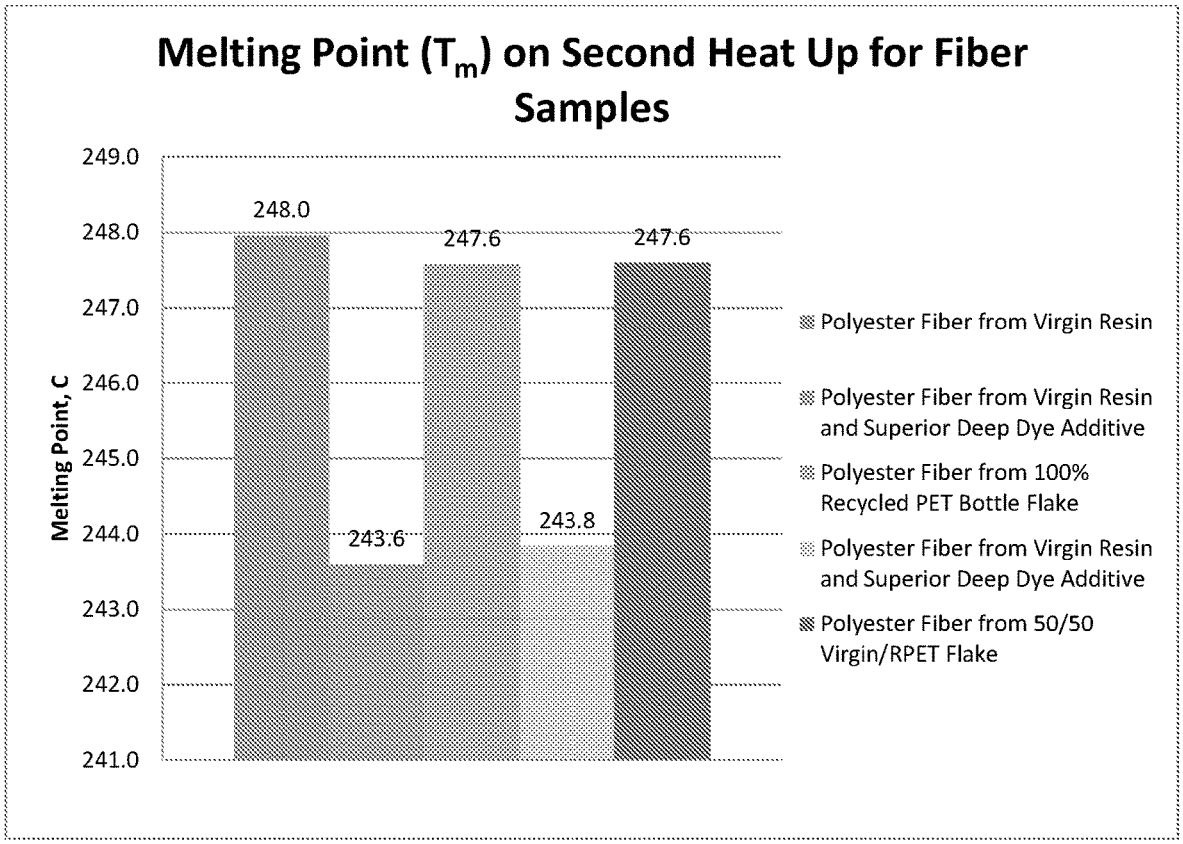
FIG. 1 is a graph demonstrating that a very small amount of SDD reduces the melting point of polyester fibers. The reduction in melting point enables the polyester fibers to pick up more dye when exposed to a dye bath during dye application. The SDD reduces the melting point of polyester fibers by approximately 4 degrees Celsius.

The following terms are intended to have the meanings presented therewith below and are useful in understanding the description and intended scope of the present invention.

As used in the specification and the appended claims, the singular forms "a," "an" and "the" include plural referents unless the context clearly dictates otherwise. Thus, for example, reference to "a composition," "a fiber," or "a step" includes mixtures of two or more such functional compositions, fibers, steps, and the like.

Ranges can be expressed herein as from "about" one particular value, and/or to "about" another particular value. When such a range is expressed, another aspect includes from the one particular value and/or to the other particular value. Similarly, when values are expressed as approximations, by use of the antecedent "about," it will be understood that the particular value forms another aspect. It will be further understood that the endpoints of each of the ranges are significant both in relation to the other endpoint, and independently of the other endpoint. It is also understood that there are a number of values disclosed herein, and that each value is also herein disclosed as "about" that particular value in addition to the value itself. For example, if the value "10" is disclosed, then "about 10" is also disclosed. It is also understood that each unit between two particular units are also disclosed. For example, if 10 and 15 are disclosed, then 11, 12, 13, and 14 are also disclosed.

References in the specification and concluding claims to parts by weight of a particular element or component in a composition denotes the weight relationship between the element or component and any other elements or components in the composition or article for which a part by weight is expressed. Thus, in a compound containing 2 parts by weight of component X and 5 parts by weight component Y, X and Y are present at a weight ratio of 2:5, and are present in such ratio regardless of whether additional components are contained in the compound.

A weight percent (wt. %) of a component, unless specifically stated to the contrary, is based on the total weight of the formulation or composition in which the component is included.

As used herein, the terms "optional" or "optionally" means that the subsequently described event or circumstance can or cannot occur, and that the description includes instances where said event or circumstance occurs and instances where it does not.

As used herein, the term "effective amount" refers to an amount that is sufficient to achieve the desired result or to have an effect on an undesired condition.

As used herein, the term "polymer" refers to a relatively high molecular weight organic compound, natural or synthetic, whose structure can be represented by a repeated small unit, the monomer (e.g., polyethylene, rubber, cellulose). Synthetic polymers are typically formed by addition or condensation polymerization of monomers. Homopolymers (i.e., a single repeating unit) and copolymers (i.e., more than one repeating unit) are two categories of polymers. Certain materials, compounds, compositions, and components disclosed herein can be obtained commercially or readily synthesized using techniques generally known to those of skill in the art. For example, the starting materials and reagents used in preparing the disclosed compounds and compositions are either available from commercial suppliers such as Aldrich Chemical Co., (Milwaukee, Wis.), Acros Organics (Morris Plains, N.J.), Fisher Scientific (Pittsburgh, Pa.), or Sigma (St. Louis, Mo.) or are prepared by methods known to those skilled in the art following procedures set forth in references such as Fieser and Fieser's Reagents for Organic Synthesis, Volumes 1-17 (John Wiley and Sons, 1991); Rodd's Chemistry of Carbon Compounds, Volumes 1-5 and Supplementals (Elsevier Science Publishers, 1989); Organic Reactions, Volumes 1-40 (John Wiley and Sons, 1991); March's Advanced Organic Chemistry, (John Wiley and Sons, 4th Edition); and Larock's Comprehensive Organic Transformations (VCH Publishers Inc., 1989).

Unless otherwise expressly stated, it is in no way intended that any method set forth herein be construed as requiring that its steps be performed in a specific order. Accordingly, where a method claim does not actually recite an order to be followed by its steps or it is not otherwise specifically stated in the claims or descriptions that the steps are to be limited to a specific order, it is no way intended that an order be inferred, in any respect. This holds for any possible non-express basis for interpretation, including: matters of logic with respect to arrangement of steps or operational flow; plain meaning derived from grammatical organization or punctuation; and the number or type of embodiments described in the specification.

The term "compound" as used herein, refers to salts, complexes, isomers, stereoisomers, diastereoisomers, tautomers, and isotopes of the compound or any combination thereof.

The term "comprising" (and any form of comprising, such as "comprise", "comprises", and "comprised"), "having" (and any form of having, such as "have" and "has"), "including" (and any form of including, such as "includes"

and "include"), or "containing" (and any form of containing, such as "contains" and "contain"), are used in their inclusive, open-ended, and non-limiting sense.

The term "effective," as that term is used in the specification and/or claims, means adequate to accomplish a desired, expected, or intended result.

The term "fiber" or "fibers" as used in this specification and the appended claims is intended to have a relatively broad meaning and to refer to fibers of all lengths and diameters. Specifically, what some refer to in the industry as "filaments" are also included within this definition. Also, the term "fibers" refers to the fibers whether they be separate fibers, formed into yarns, woven into fabrics, tufted into carpets, or formed into nonwoven fabrics.

The phrase "polymeric fibers with limited dye sites" and similar phrases as used in this specification and the appended claims are intended to refer both to fibers which inherently have limited dye sites as well as to those which have been treated to reduce or block the inherent dye sites. In particular, the phrase includes fibers made of a polymer, such as polypropylene, which inherently has limited dye sites because of its chemical structure. In addition, the phrase includes fibers made from a polymer which has been treated to have its inherent dye sites blocked as, for example, nylon fibers which have been treated with a stain resistant treatment.

The term "polymeric fibers with difficult to penetrate chemical structures" and similar phrases as used in this specification and the appended claims is intended to refer to fibers, such as polyester, which are substantially impenetrable to typical aqueous and non-aqueous dye solutions because they inherently have highly aligned crystalline structures.

The term "dye" as used in this specification and the appended claims is intended to have a relatively broad meaning and refers to the coloring of the polymeric fibers. The term also includes applications of the dye composition to the fibers in spaced patterns that could be termed printing.

The term "disperse dye" as used in this specification and the appended claims is intended to refer to a class of dyes which do not contain molecular anionic or cationic charges and tend to disperse themselves in fibers.

Unless otherwise stated, the dye names set forth herein conform to the dyes listed in the Colour Index International, 3$^{rd}$ Ed., published by The Society of Dyers and Colourists. One of ordinary skill in the art will recognize that this publication generally serves to define the standard names for dyes utilized in the textile industry.

As used herein, and unless the context clearly indicates otherwise, the term "carpet" is used to generically include broadloom carpet, carpet tiles, and even area rugs. To that end, "broadloom carpet" means a broadloom textile flooring product manufactured for and intended to be used in roll form. The term "carpet tile" denotes a modular floor covering, conventionally in 18"×18," 24"×24" or 36"×36" squares, but other sizes and shapes are also within the scope of the present invention.

The term "swelling agent" as used in this specification and the appended claims is also intended to have a relatively broad meaning and to refer to those compounds which affect at least a degree of swelling in the polymeric fibers.

II. Polyester Fiber Dyeing Processes with Superior Deep Dye (SDD) Additive

According to various aspects of the disclosure, the invention relates to a process for dyeing a fabric. In further aspects, the invention relates to a process for dyeing polyester fibers. Novel polyester fiber dyeing processes containing SDD are provided. One suitable polyester is sold by Invista under the designation DACRON can be used in the invention but one of ordinary skill in the art will recognize that other polyester fibers are suitable for use and the example above of a suitable polyester is meant only for illustration and not meant to be inclusive.

In an aspect, the dye used in the present invention is a disperse dye. As noted above, a disperse dye is a dye which does not rely on chemical bonding to the substrate. Rather a disperse dye works by being dispersed within the substrate. Experiments have shown that dyes that contain ionic charges, such as acid dyes, pre-metalized dyes, catatonic dyes, direct dyes, and fiber reactive dyes, do not perform well in the present method or composition.

In general, the selection of the particular disperse dye or combination of dyes to be used with a particular fiber will depend on several factors. Naturally, the color desired will be amongst the most important. Other important factors include, but are not limited to, factors such as dye affinity, lightfastness and cost.

Typically, disperse dyes are categorized as low, medium or high energy depending on their molecular size and the amount of energy necessary to exhaust them on a fiber. In one embodiment contemplated by the present invention, the disperse dyes are medium energy dyes, while an alternate embodiment contemplates high energy dyes as within scope of the present invention. Experiments have shown that, at least with polypropylene fibers, low energy disperse dyes have shown lower color yields.

Experiments have also shown that certain disperse dyes appear to have good affinity for polyester fibers while other disperse dyes, which have good affinity on other types of fibers, have lower affinity on polyester. To date, this affinity does not appear to be correlated with the energy level of the disperse dye.

Another factor in the selection of the disperse dye to be used in the present invention is the lightfastness of the color within the fiber. Experiments have shown that some dyes which have a high affinity for polyester fibers have poor lightfastness while some with lower affinity have good lightfastness.

Finally, unless stated to the contrary, all percentages provided herein are percentages by weight.

Throughout this document, where publications are referenced, the disclosures of these publications in their entireties are hereby incorporated by reference in order to more fully describe the present invention.

It was unexpectedly and surprisingly discovered that adding a very small amount of superior deep dye (SDD) to polyester fibers during the fiber spinning process reduces the melting point of the polyester fibers.

It was also unexpectedly and surprisingly discovered that adding a very small amount of SDD to polyester fibers during the fiber spinning process reduces the crystallinity of the polyester fibers.

It was further unexpectedly and surprisingly discovered that adding a very small amount of SDD to polyester fibers during the fiber spinning process increases the dye pick-up on the polyester fibers.

In some embodiments, a process of dyeing a polyester fiber, can include feeding a plurality of dried polyester pellets and SDD additive into a twin-screw extruder; mixing polyester pellets and SDD via screw configuration of the twin-screw extruder; removing the volatiles via connected vacuum pump to the twin-screw extruder; passing molten polyester pellets and SDD through a die to produce strands; pelletizing, crystallizing, drying the pellets to produce a concentrate; spinning blends of the concentrate and virgin polyester resin into a fiber; selectively applying one or more colors of dye at about 100° F.; adjusting the pH of the dye bath between 4-7; applying the stream for about 10 minutes at about 210° F.; rinsing the polyester fiber; applying after treatment; applying the stream for about 3 minutes at about 210° F.; and rinsing and drying the dyed polyester fiber.

In another embodiment, a process of dyeing a polyester fiber, can include feeding a plurality of dried polyester pellets and superior deep dye (SDD) additive into a single-screw extruder; mixing polyester pellets and SDD via screw configuration of the single-screw extruder; removing the volatiles via connected vacuum pump to the single-screw extruder; passing molten polyester pellets and SDD through a die to produce strands; pelletizing, crystallizing, drying the pellets to produce a concentrate; spinning blends of the concentrate and virgin polyester resin into a fiber; selectively applying one or more colors of dye at about 100° F.; adjusting the pH of the dye bath between 4-7; applying the stream for about 10 minutes at about 210° F.; rinsing the polyester fiber; applying after treatment; applying the stream for about 3 minutes at about 210° F.; and rinsing and drying the dyed polyester fiber.

In another embodiment, the polyester pellets are dried overnight at 275° F. using desiccated air having a dew point of −40° C.

In certain embodiment, SDD is fed through a calibrated flow meter, through a positive displacement pump or combinations thereof.

In one embodiment, the SDD can include a high temperature thermally stable SDD.

In further embodiments, the SDD is selected from the group consisting of modified terphenyls, mixtures of synthetic aromatics, terphenyl/quaterphenyl, biphenyl/diphenyl oxide (DPO) eutectic mixtures, phenylcyclohexane/bicyclohexyl mixtures, and any combinations thereof. The modified terphenyl is a clear pale yellow liquid and is pumpable at low temperatures. The modified terphenyl additionally offers high temperature thermal stability. Other SDDs that can be used preferably have high temperature thermal stability and be pumpable at low temperatures.

In one embodiment, two or more SDDs are present.

In some embodiments, the temperature ranges from about −50° C. to about 350° C. In some preferred embodiments, the temperature ranges from about 0° C. to about 325° C. In some more preferred embodiments, the temperature ranges from about 20° C. to about 310° C.

In another embodiment, the % of SDD varies from about 0.01% to about 1.0%. In other embodiments, the % of SDD is less than 1%. Preferably, the % of SDD is less than 0.5%. More preferably, the % of SDD is less than 0.01%.

In certain embodiments, the polyesters are selected from the group consisting of poly(ethylene terephthalate) (PET), poly(butylene terephthalate) (PBT), poly(trimethylene terephthalate) (PTT), poly(ethylene naphthalate) (PEN), linear polyesters, cross-linked polyesters, bio-based polyesters and combinations thereof.

The fibers may be formed from the polymer blend by any method known in the art to produce fibers from a single polyester or from a blend. The polymeric blend can be extruded to have any shape or dimension suitable to polymeric carpet fibers. Moreover, the carpet fibers can undergo any post-spinning processes generally recognized as useful in the preparation of polymeric carpet fibers. By "fibers", reference is made to items, recognized in the art as fibers, such as continuous filaments, monofilaments, staple fibers, and the like. The fibers can be round or have other shapes, such as octalobal, delta, sunburst (also known as sol), scalloped oval, trilobal, window pane, tetra-channel (also known as quatra-channel), scalloped ribbon, ribbon, starburst, and the like. The fibers may also be solid, hollow, or multi-hollow. The fibers can be used to make yarns, and the fibers or yarns can be used to prepare a number of materials, particularly carpets, rugs, mats, and the like.

The invention also provides for a carpet comprising a fiber or a yarn. One embodiment of carpet, a tufted carpet, includes fiber tufts, backing, filler material, and adhesive material. In some arrangements, the backing can include two components: the primary backing and the secondary backing. The carpet may also include any number of other layers, depending upon its intended use.

In some embodiments, a yellow component can include one or more of a dye selected from the group consisting of C.I. Disperse Yellow 54, C.I. Disperse Yellow 64, C.I. Disperse Yellow 114, C.I. Disperse Yellow 211, or any C.I. Disperse Yellow dye and any mixtures thereof.

In other embodiments, an orange component can include one or more of a dye selected from the group consisting of C.I. Disperse Orange 25, C.I. Disperse Orange 30, C.I. Disperse Orange 31, C.I. Disperse Orange 44, C.I. Disperse Orange 61, or any C.I. Disperse Orange dye and any mixtures thereof.

In further embodiments, a red component can include one or more of a dye selected from the group consisting of C.I. Disperse Red 50, C.I. Disperse Red 60, C.I. Disperse Red 73, C.I. Disperse Red 82, C.I. Disperse Red 167, C.I. Disperse Red 324, C.I. Disperse Red 356, C.I. Disperse Red 376, C.I. Disperse Red 382, C.I. Disperse Red 383, or any C.I. Disperse Red dye and any mixtures thereof.

In another embodiment, a violet component can include one or more of a dye selected from the group consisting of C.I. Disperse Violet 93:1, C.I. Disperse Violet 107 or any C.I. Disperse Violet dye and any mixtures thereof.

In certain embodiments, a blue component can include one or more of a dye selected from the group consisting of C.I. Disperse Blue 56, C.I. Disperse Blue 60, C.I. Disperse Blue 77, C.I. Disperse Blue 79:1, C.I. Disperse Blue 93:1, C.I. Disperse Blue 165, C.I. Disperse Blue 284, C.I. Disperse Blue 291, C.I. Disperse Blue 354 or any C.I. Disperse Blue dye and any mixtures thereof.

In some embodiments, the melting point of the polyester fiber is reduced by about 0° C. to about 20° C., preferably, the melting point of the polyester fiber is reduced from about 0° C. to about 15° C., and more preferably, the melting point of the polyester fiber is reduced from about 0° C. to about 10° C.

In other embodiments, the % of crystallinity of the polyester fiber is reduced by about 0% to about 10%, preferably, the % of crystallinity of the polyester fiber is reduced from about 0% to about 5%, and more preferably, the % of crystallinity of the polyester fiber is reduced from about 0% to about 3%.

In another embodiment, the dye pick-up on the polyester fiber is increased from about 80% to about 100%, preferably, the dye pick-up on the polyester fiber is increased to about 100%.

In some embodiments, the dye bath comprises one or more additives.

In such embodiments, the additives are selected from the group consisting of a wetting agent, a leveling agent, a buffering agent, a pH adjusting agent, a light fastness enhancing agent, an antimicrobial agent, a water treatment agent and any combinations thereof.

In some embodiments, the process produces a random dye pattern.

In other embodiments, the process produces a non-repeatable dye pattern.

In another embodiment, the process produces a variable dye pattern.

In certain embodiments, the process produces a dye pattern having a visual effect of blending of multiple sequential shades of the dye formulation.

FIG. 1 is a graph demonstrating that a very small amount of SDD reduces the melting point of polyester fibers. The reduction in melting point enables the polyester fibers to pick up more dye when exposed to a dye bath during dye application. The SDD reduces the melting point of polyester fibers by approximately 4 degrees Celsius.

Figure 2:
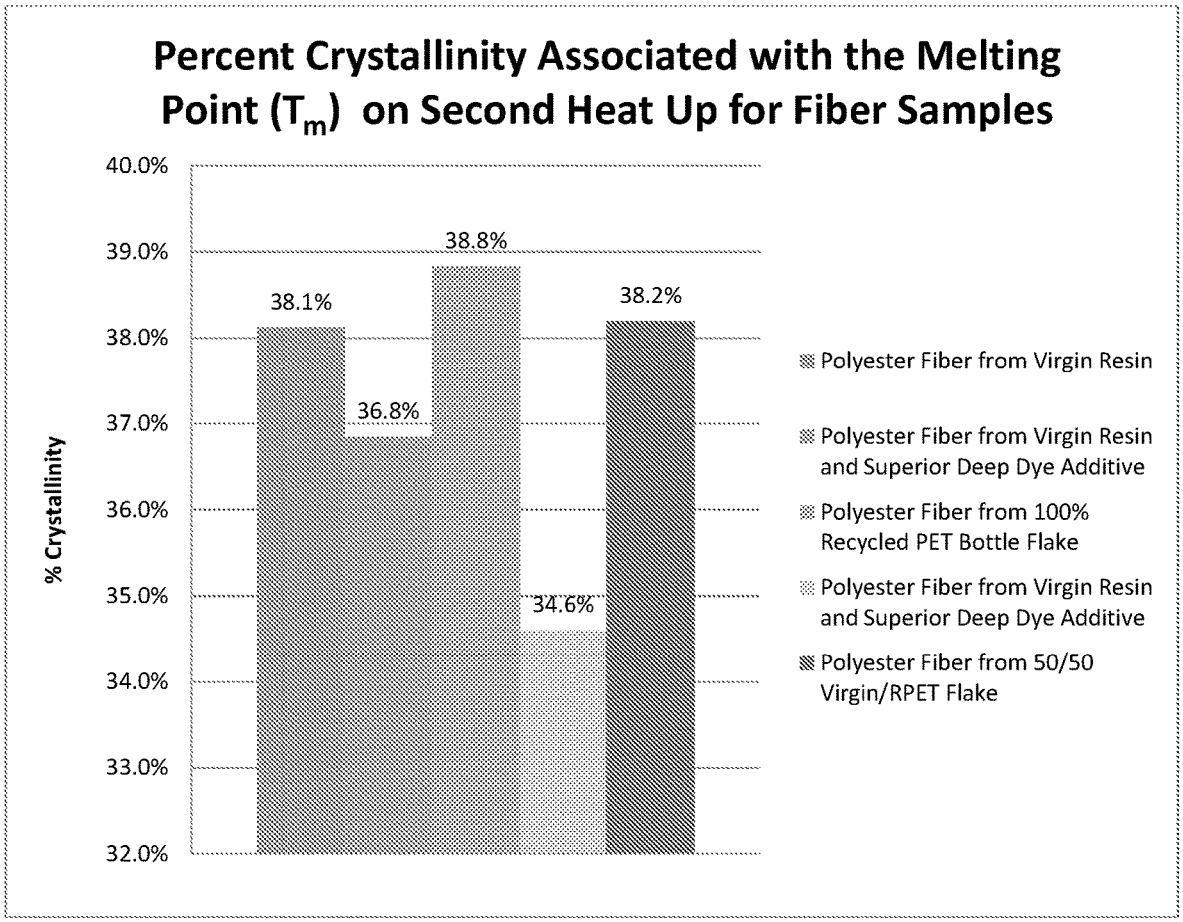
FIG. 2 is a graph demonstrating that a small amount of SDD reduces the crystallinity of polyester fibers. The reduction in crystallinity enables the polyester fibers to pick up more dye when exposed to a dye bath during dye application.

FIG. 2 is a graph demonstrating that a very small amount of SDD reduces the crystallinity of polyester fibers. The reduction in crystallinity enables the polyester fibers to pick up more dye when exposed to a dye bath during dye application.

Figure 3:
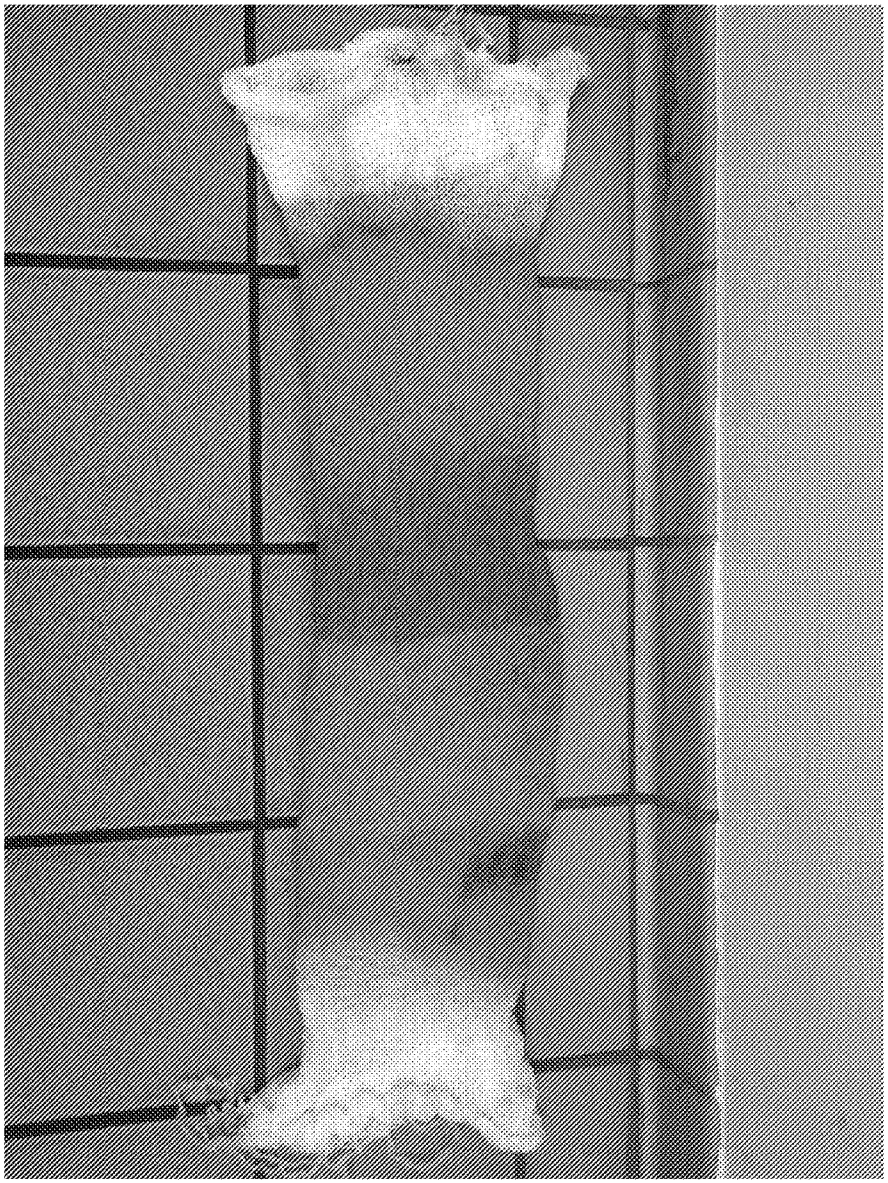
FIG. 3 is a photo of a knitted sock that shows how SDD affects the dye uptake of a polyester fiber.

FIG. 3 shows how a small amount of SDD affects the dye uptake of polyester fiber. Four bands are shown in FIG. 3 proceeding from left to right as follows:

1. Polyester fiber singles made with virgin resin (light band on the left)
2. Polyester fiber singles made with the resin containing a small amount of SDD (second band from the left)
3. Polyester fiber singles made with virgin resin-same raw material composition as in the first band (third band from the left)
4. The last band was a polyester fiber singles lot made that had 30% RPET in it, it was another comparison to the virgin samples.

III. Compositions for Dyeing Polyester Fiber Containing Superior Deep Dye (SDD) Additive In some embodiments, a composition for dyeing polyester fibers, can include a SDD; and a dye component, wherein the dye component is a disperse dye.

IV. Compositions for Fiber Manufacturing Containing Superior Deep Dye (SDD) Additive In other embodiments, a composition for fiber manufacturing, can include, a plurality of polyester fibers; and a SDD.

V. Industrial Applications

It was unexpectedly and surprisingly discovered that adding a very small amount of SDD to molten polyester during the fiber spinning process reduces the melting point and crystallinity, and increases the dye pick-up of the polyester fibers on an industrial scale. Further, the present invention is about efficient polyester fibers dyeing processes and dyeing compositions on large industrial scale. The dyed polyester fibers produced using this process exhibit high light fastness, high heat fastness and high sublimation fastness. The dyed polyester fibers produced using this process also exhibit increased dye pick up.

EXAMPLES

To provide a better understanding of the foregoing discussion, the following non-limiting examples are provided. Although the examples may be directed to specific embodiments, they are not to be viewed as limiting the invention in any specific respect.

Example 1: Concentrate Process

PET pellets are dried overnight at 275° F. using desiccated air having a dew point of −40° C. The dried PET pellets are fed to a throat of a twin-screw extruder and at the same time the SDD are fed to the throat of the same twin screw extruder. PET is fed to the extruder by a loss of weight feeder so that a given amount of PET is fed during a given time frame. Similarly, the SDD is fed to the throat of a twin-screw extruder by several methods, either through a calibrated flow meter or through a positive displacement pump. The screw configuration of the twin screw extruder is set up to provide intensive mixing of the molten PET and the SDD, through a series of mixing elements, conveying elements and reverse flow elements. There is a vacuum port on the twin screw extruder connected to a vacuum pump that is used to remove volatiles such as moisture. The molten polymer/SDD mix is forced through a die to produce strands that are quenched in a cold-water bath. The strands are pelletized, then crystallized and dried overnight so that they could be used as a Concentrate for the spinning of fiber. The concentrate is incorporated into the fiber at different loadings to provide the final concentration of the SDD in the fiber.

Example 2: Dyeing Polyester Fibers Using Superior Deep Dye (SDD) Additive

PET pellets are dried overnight at 275° F. using desiccated air having a dew point of −40° C. The dried PET pellets are fed to a throat of a single-screw extruder and at the same time the SDD are fed to the throat of the same single-screw extruder. PET is fed to the extruder by a loss of weight feeder so that a given amount of PET is fed during a given time frame. Similarly, the SDD is fed to the throat of a single-screw extruder by several methods, either through a calibrated flow meter or through a positive displacement pump. The molten polymer/SDD mix is forced through a spinneret to produce filaments that can be air quenched. The filaments are drawn by heated Godets and wound onto a tube by a winder.

While in the foregoing specification this invention has been described in relation to certain embodiments thereof, and many details have been put forth for the purpose of illustration, it will be apparent to those skilled in the art that the invention includes additional embodiments and that certain of the details described herein can be varied considerably without departing from the basic principles of the invention. Although we have described the preferred embodiments for implementing our invention, it will be understood by those skilled in the art to which this disclosure is directed that modifications and additions may be made to our invention without departing from its scope.

All references cited herein are incorporated by reference in their entirety. The present invention may be embodied in other specific forms without departing from the spirit or essential attributes thereof and, accordingly, reference should be made to the appended claims, rather than to the foregoing specification, as indicating the scope of the invention.

Embodiments of the present disclosure further relate to any one or more of the following paragraphs:

1. A process of dyeing a polyester fiber, comprising: feeding a plurality of dried polyester pellets and superior deep dye (SDD) additive into a twin-screw extruder; mixing polyester pellets and SDD via screw configuration of the twin-screw extruder; removing the volatiles via connected vacuum pump to the twin-screw extruder; passing molten polyester pellets and SDD through a die to produce strands; pelletizing, crystallizing, drying the pellets to produce a concentrate; spinning blends of the concentrate and virgin polyester resin into a fiber; selectively applying one or more colors of dye at about 100° F.; adjusting the pH of the dye bath between 4-7; applying the stream for about 10 minutes at about 210° F.; rinsing the polyester fiber; applying after treatment; applying the stream for about 3 minutes at about 210° F.; and rinsing and drying the dyed polyester fiber.

2. A process of dyeing a polyester fiber, comprising: feeding a plurality of dried polyester pellets and superior deep dye (SDD) additive into a single-screw extruder; mixing polyester pellets and SDD via screw configuration of the single-screw extruder; removing the volatiles via connected vacuum pump to the single-screw extruder; passing molten polyester pellets and SDD through a die to produce strands; pelletizing, crystallizing, drying the pellets to produce a concentrate; spinning blends of the concentrate and virgin polyester resin into a fiber; selectively applying one or more colors of dye at about 100° F.; adjusting the pH of the dye bath between 4-7; applying the stream for about 10 minutes at about 210° F.; rinsing the polyester fiber; applying after treatment; applying the stream for about 3 minutes at about 210° F.; and rinsing and drying the dyed polyester fiber.

3. The process of paragraph 1, wherein the polyester pellets are dried overnight at 275° F. using desiccated air having a dew point of −40° C.

4. The process of paragraph 1, wherein SDD is fed through a calibrated flow meter, through a positive displacement pump or combinations thereof.

5. The process of paragraph 1, wherein the SDD is selected from the group consisting of modified terphenyls, mixtures of synthetic aromatics, terphenyl/quaterphenyl, biphenyl/diphenyl oxide (DPO) eutectic mixture, and phenylcyclohexane plus bicyclohexyl mixture and mixtures thereof.

6. The process of paragraph 1, wherein two or more SDDs are present.

7. The process of paragraph 1, wherein, the SDD comprises a high temperature thermally stable SDD.

8. The process of paragraph 1, wherein the temperature ranges from about −50° C. to about 350° C.

9. The process of paragraph 1, wherein the % of SDD varies from about 0.01% to about 1.0%.

10. The process of paragraph 1, wherein the polyesters are selected from the group consisting of poly(ethylene terephthalate) (PET), poly(butylene terephthalate) (PBT), poly(trimethylene terephthalate) (PTT), poly(ethylene naphthalate) (PEN), linear polyesters, cross-linked polyesters, bio-based polyesters and combinations thereof.

11. The process of paragraph 1, wherein the yellow component comprises one or more of a dye selected from the group consisting of C.I. Disperse Yellow 54, C.I. Disperse Yellow 64, C.I. Disperse Yellow 114, C.I. Disperse Yellow 211, or any C.I. Disperse Yellow dye and mixtures thereof.

12. The process of paragraph 1, wherein the orange component comprises one or more of a dye selected from the group consisting of C.I. Disperse Orange 25, C.I. Disperse Orange 30, C.I. Disperse Orange 31, C.I. Disperse Orange 44, C.I. Disperse Orange 61, or any C.I. Disperse Orange dye and mixtures thereof.

13. The process of paragraph 1, wherein the red component comprises one or more of a dye selected from the group consisting of C.I. Disperse Red 50, C.I. Disperse Red 60, C.I. Disperse Red 73, C.I. Disperse Red 82, C.I. Disperse Red 167, C.I. Disperse Red 324, C.I. Disperse Red 356, C.I. Disperse Red 376, C.I. Disperse Red 382, C.I. Disperse Red 383, or any C.I. Disperse Red dye and mixtures thereof.

14. The process of paragraph 1, wherein the violet component comprises one or more of a dye selected from the group consisting of C.I. Disperse Violet 93:1, C.I. Disperse Violet 107 or any C.I. Disperse Violet dye and mixtures thereof.

15. The process of paragraph 1, wherein the blue component comprises one or more of a dye selected from the group consisting of C.I. Disperse Blue 56, C.I. Disperse Blue 60, C.I. Disperse Blue 77, C.I. Disperse Blue 79:1, C.I. Disperse Blue 93:1, C.I. Disperse Blue 165, C.I. Disperse Blue 284, C.I. Disperse Blue 291, C.I. Disperse Blue 354 or any C.I. Disperse Blue dye and mixtures thereof.

16. The process of paragraph 1, wherein the melting point of the polyester fiber is reduced from about 0° C. to about 20° C.

17. The process of paragraph 1, wherein the % of crystallinity of the polyester fiber is reduced from about 0% to about 10%.

18. The process of paragraph 1, wherein the dye pick-up on the polyester fiber is increased from about 80% to about 100%.

19. The process of paragraph 1, wherein the dye bath comprises one or more additives.

20. The process of paragraph 19, wherein the additives are selected from the group consisting of a wetting agent, a leveling agent, a buffering agent, a pH adjusting agent, a light fastness enhancing agent, an antimicrobial agent, a water treatment agent and a combination thereof.

21. The process of paragraph 1, wherein the process produces a random dye pattern.

22. The process of paragraph 1, wherein the process produces a non-repeatable dye pattern.

23. The process of paragraph 1, wherein the process produces a variable dye pattern.

24. The process of paragraph 1, wherein the process produces a dye pattern having a visual effect of blending of multiple sequential shades of the dye formulation.

25. A composition for dyeing polyester fibers, comprising: a superior deep dye (SDD) additive; and a dye component, wherein the dye component is a disperse dye.

26. A composition for fiber manufacturing, comprising: a plurality of polyester fibers; and a superior deep dye (SDD) additive.

We claim:

1. A process of dyeing a polyester fiber, comprising:

feeding a plurality of dried polyester pellets and superior deep dye (SDD) additive into a screw extruder;

mixing polyester pellets and SDD additive via screw configuration of the screw extruder;

removing the volatiles via connected vacuum pump to the screw extruder;

passing molten polyester pellets and SDD through a die to produce strands;

pelletizing, crystallizing, drying the pellets to produce a concentrate;

spinning blends of the concentrate and virgin polyester resin into a fiber;

selectively applying one or more colors of dye at about 100° F.;

adjusting the pH of the dye bath between 4-7;

applying the stream for about 10 minutes at about 210° F.;

rinsing the polyester fiber;

applying after treatment;

applying the stream for about 3 minutes at about 210° F.; and rinsing and drying the dyed polyester fiber.

2. The process of claim 1, wherein the screw extruder is a twin-screw or a single-screw extruder.

3. The process of claim 1, wherein the polyester pellets are dried overnight at 275° F. using desiccated air having a dew point of −40° C.

4. The process of claim 1, wherein SDD is fed through a calibrated flow meter, through a positive displacement pump or combinations thereof.

5. The process of claim 1, wherein the SDD is selected from the group consisting of modified terphenyls, mixtures of synthetic aromatics, terphenyl/quaterphenyl, biphenyl/diphenyl oxide (DPO) eutectic mixture, and phenylcyclohexane plus bicyclohexyl mixture and mixtures thereof.

6. The process of claim 1, wherein two or more SDDs are present.

7. The process of claim 1, wherein the temperature ranges from about −50° C. to about 350° C.

8. The process of claim 1, wherein the % of SDD varies from about 0.01% to about 1.0%.

9. The process of claim 1, wherein the polyesters are selected from the group consisting of poly(ethylene terephthalate) (PET), poly(butylene terephthalate) (PBT), poly (trimethylene terephthalate) (PTT), poly(ethylene naphthalate) (PEN), linear polyesters, cross-linked polyesters, bio-based polyesters and combinations thereof.

10. The process of claim 1, wherein the yellow component comprises one or more of a dye selected from the group consisting of C.I. Disperse Yellow 54, C.I. Disperse Yellow 64, C.I. Disperse Yellow 114, C.I. Disperse Yellow 211, or any C.I. Disperse Yellow dye and mixtures thereof.

11. The process of claim 1, wherein the red component comprises one or more of a dye selected from the group consisting of C.I. Disperse Red 50, C.I. Disperse Red 60, C.I. Disperse Red 73, C.I. Disperse Red 82, C.I. Disperse Red 167, C.I. Disperse Red 324, C.I. Disperse Red 356, C.I. Disperse Red 376, C.I. Disperse Red 382, C.I. Disperse Red 383, or any C.I. Disperse Red dye and mixtures thereof.

12. The process of claim 1, wherein the blue component comprises one or more of a dye selected from the group consisting of C.I. Disperse Blue 56, C.I. Disperse Blue 60, C.I. Disperse Blue 77, C.I. Disperse Blue 79:1, C.I. Disperse Blue 93:1, C.I. Disperse Blue 165, C.I. Disperse Blue 284, C.I. Disperse Blue 291, C.I. Disperse Blue 354 or any C.I. Disperse Blue dye and mixtures thereof.

13. The process of claim 1, wherein the melting point of the polyester fiber is reduced by about 0° C. to about 20° C.

14. The process of claim 1, wherein the % of crystallinity of the polyester fiber is reduced from about 0% to about 10%.

15. The process of claim 1, wherein the dye pick-up on the polyester fiber is increased from about 80% to about 100%.

16. The process of claim 1, wherein the dye bath comprises one or more additives selected from the group consisting of a wetting agent, a leveling agent, a buffering agent, a pH adjusting agent, a light fastness enhancing agent, an antimicrobial agent, a water treatment agent and a combination thereof.

17. The process of claim 1, wherein the process produces a pattern selected from the group consisting of a random dye pattern, a non-repeatable dye pattern, a variable dye pattern, a dye pattern having a visual effect of blending of multiple sequential shades of the dye formulation and any combinations thereof.

18. A method of providing a polyester fiber, the method comprising:

a. forming a mixture comprising a polyester and a superior deep dye additive; and b. extruding the mixture into a fiber, wherein the fiber has a lowered melting point and an enhanced dye retention in comparison to virgin polyester fibers without the superior deep dye additive.

19. The method of claim 18, wherein the superior deep dye additive is selected from a group consisting of modified terphenyls, synthetic aromatics, terphenyl, quaterphenyl, biphenyl, diphenyl oxide, a biphenyl-diphenyl oxide (DPO) eutectic mixture, phenylcyclohexane, bicyclohexyl, and any combinations thereof.

20. A method of providing a pellet, the pellet comprising an elevated concentration of an additive, the method comprising:

a. forming a mixture comprising a polymeric material and a superior deep dye additive;

b. extruding the mixture into a fiber; and c. pelletizing the fiber to form pellets comprising the elevated concentration of the additive, wherein the pellets are configured to reduce melting points and enhance dye retention of a desired fiber when added to virgin polyester.

* * * * *